US009527558B2

(12) United States Patent
Davis et al.

(10) Patent No.: US 9,527,558 B2
(45) Date of Patent: Dec. 27, 2016

(54) METHOD AND APPARATUS FOR MARINE-BASED LIGHTING MECHANISMS

(71) Applicant: JST Performance, LLC, Gilbert, AZ (US)

(72) Inventors: David A. Davis, Mesa, AZ (US); Christopher P. Largent, Phoenix, AZ (US)

(73) Assignee: JST Performance, LLC, Gilbert, AZ (US)

( * ) Notice: Subject to any disclaimer, the term of this patent is extended or adjusted under 35 U.S.C. 154(b) by 0 days.

(21) Appl. No.: 14/325,245

(22) Filed: Jul. 7, 2014

(65) Prior Publication Data

US 2015/0016130 A1 Jan. 15, 2015

Related U.S. Application Data

(60) Provisional application No. 61/844,281, filed on Jul. 9, 2013.

(51) Int. Cl.
*B63B 45/02* (2006.01)

(52) U.S. Cl.
CPC ..... *B63B 45/02* (2013.01); *Y10T 29/49826* (2015.01)

(58) Field of Classification Search
CPC ..... B63B 45/00; B63B 45/02; B63B 45/04; B63C 9/21
USPC ..... 362/477
See application file for complete search history.

(56) References Cited

U.S. PATENT DOCUMENTS

| | | | | |
|---|---|---|---|---|
| 2,887,563 | A * | 5/1959 | Kiekhaefer | 362/253 |
| 2002/0172051 | A1* | 11/2002 | Redding | 362/477 |
| 2005/0099819 | A1* | 5/2005 | Lilly | 362/477 |
| 2007/0049137 | A1* | 3/2007 | Lemchen | 440/2 |

* cited by examiner

*Primary Examiner* — Andrew Coughlin

(57) ABSTRACT

A method and apparatus for incorporating lighting fixtures (e.g., Light Emitting Diode (LED) lighting fixtures) within other non-lighting components, or their mounting structures, already mounted to a watercraft. A mounting bracket that may be used to mount the non-lighting component to the watercraft may be modified to include a mounting bracket for the LED lighting device. The light fixture may be incorporated into the non-lighting component mount without utilizing any extra surface area on the watercraft itself.

20 Claims, 4 Drawing Sheets

METHOD AND APPARATUS FOR MARINE-BASED LIGHTING MECHANISMS

FIELD OF THE INVENTION

The present invention generally relates to lighting mechanisms, and more particularly to marine-based lighting mechanisms.

BACKGROUND

Lighting mechanisms for use in marine applications (e.g., fishing boats) are numerous. Navigation lights, for example, may be implemented as colored lights (e.g., a red light on the port side and a green light on the starboard side) so that when two or more watercraft are on intersecting paths, the crew occupying one watercraft may determine the position, heading and status of the other watercraft by monitoring the location of each navigation light in relation to the approaching watercraft. Accordingly, right-of-way may be established between each watercraft.

As per other examples, docking lights, underwater lights, courtesy lights, utility lights and task lights may also be utilized in marine applications, where virtually all such lighting may utilize dedicated mounts. Accordingly, precious surface area that may be utilized for other applications, is instead required to be used for the lighting applications themselves.

Efforts continue, therefore, to develop techniques that may incorporate lighting fixtures within structures already mounted to the watercraft, so that lighting may be provided without unnecessarily wasting surface area.

SUMMARY

To overcome limitations in the prior art, and to overcome other limitations that will become apparent upon reading and understanding the present specification, various embodiments of the present invention disclose methods and apparatus for incorporating lighting fixtures (e.g., Light Emitting Diode (LED) lighting fixtures) within other components already mounted to a watercraft. For example, a bracket that may be used to mount a trolling motor to a watercraft may be modified to include a mounting bracket for an LED lighting device. Accordingly, since the mounting bracket for the trolling motor is already being utilized for the trolling motor mounting function, a light fixture may be incorporated into the trolling motor mount without utilizing any extra surface area on the watercraft itself.

In accordance with one embodiment of the invention, a lighting system comprises a mounting bracket having a first side coupled to a vehicle and a second side operable to receive a trolling motor. The lighting system further comprises a light bracket coupled to the mounting bracket, the light bracket including a light fixture mounted within a cavity of the light bracket, the light fixture operable to illuminate portions outside of the vehicle.

In accordance with another embodiment of the invention, a lighting system comprises a mounting bracket having a first side coupled to a vehicle and a second side operable to receive a non-lighting device. The lighting system further comprises a light bracket coupled to the mounting bracket, the light bracket including a light fixture mounted within a cavity of the light bracket, the light fixture operable to illuminate portions outside of the vehicle.

In accordance with another embodiment of the invention, a method of mounting a light fixture comprises selecting an existing fixture mounted to a vehicle, the existing fixture being mounted along a first axis, altering at least a portion of the existing fixture to accommodate a compartment and mounting a light fixture along a second axis within the compartment.

BRIEF DESCRIPTION OF THE DRAWINGS

Various aspects and advantages of the invention will become apparent upon review of the following detailed description and upon reference to the drawings in which.

DETAILED DESCRIPTION

Generally, the various embodiments of the present invention are applied to lighting fixtures (e.g., LED lighting fixtures) that may be mounted within other fixtures, or their mounting brackets, currently existing on vehicles such as marine-based vehicles. Accordingly, for example, since those fixtures and their associated mounting brackets are already utilized on the vehicle, mounting the lighting fixtures within such other fixtures and/or their associated mounting brackets may not require any extra surface area. In so doing, lighting fixtures may be attached to vehicles, such as marine-based vehicles, without the need to utilize any extra surface area that is not already being utilized.

Figure 1:
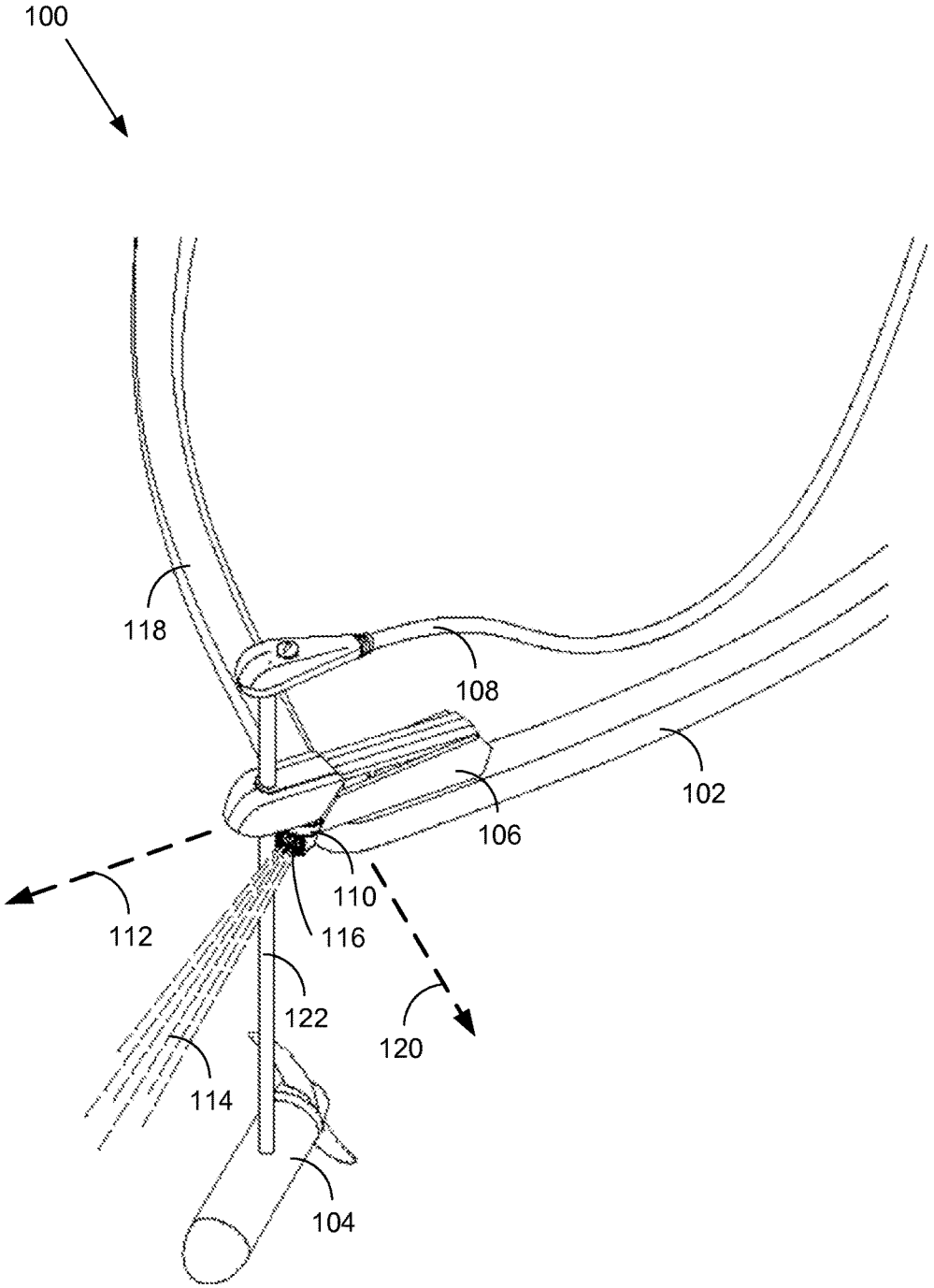
FIG. 1 illustrates a bow portion of a watercraft in accordance with one embodiment of the present invention.

Turning to FIG. 1, trolling motor 104 may be attached to a vehicle (e.g., fishing boat 100) via mounting bracket 106. Any number of mounting configurations may be utilized, such as the bow-mount configuration as illustrated in FIG. 1. As can be seen, bracket 106 may be mounted to the bow of fishing boat 100 along port side 102 of fishing boat 100. Accordingly, mounting bracket 106 may not be aligned along an axis that is parallel to the centerline of fishing boat 100, but rather may be aligned along an axis that is not parallel (e.g., along axis 112) to the centerline of fishing boat 100. Lighting bracket 110 may nevertheless provide a light-fixture compartment to house a light fixture, such that when the light fixture is mounted within the light-fixture compartment, the light fixture may be aligned along the centerline of fishing boat 100. Accordingly, once light fixture 116 is caused to illuminate, illumination pattern 114 may be directed from light fixture 116 substantially along an axis that is parallel to the centerline of fishing boat 100. As the direction of fishing boat 100 is changed (e.g., via operation of control cable 108 of trolling motor 104), the direction of illumination pattern 114 may also change to remain aligned generally in the direction that fishing boat 100 is being pulled through the water via trolling motor 104.

Alternately, bracket 106 may be mounted to the bow of fishing boat 100 along starboard side 118 of fishing boat 100. Accordingly, mounting bracket 106 may not be aligned along an axis that is parallel to the centerline of fishing boat 100, but rather may be aligned along an axis that is not parallel to the centerline of fishing boat 100 (e.g., axis 120) instead. Lighting bracket 110 may nevertheless provide a light-fixture compartment that may be aligned along the centerline of fishing boat 100, such that when the light fixture is mounted within the light-fixture compartment, the light fixture may be aligned along the centerline of fishing boat 100. Accordingly, once light fixture 116 is caused to illuminate, illumination pattern 114 may be directed from light fixture 116 substantially along an axis that is parallel to the centerline of fishing boat 100. As the direction of fishing boat 100 is changed (e.g., via operation of control cable 108 of trolling motor 104), the direction of illumination pattern 114 may also change to be aligned generally in the direction that fishing boat 100 is being pulled through the water via trolling motor 104.

It should be noted that light fixture 116 may be operational while trolling motor 104 is deployed (e.g., as illustrated in FIG. 1) and light fixture 116 may be operational while trolling motor 104 is stowed (e.g., when trolling motor 114 is out of the water and resting on mounting bracket 106). In either instance, illumination pattern 114 may be projected forward of fishing boat 100 whether or not trolling motor 104 is operational. Accordingly, extension arm 122 of trolling motor 104 may not substantially interfere with illumination pattern 114 while trolling motor 104 is operational or not.

It should be further noted that lighting bracket 110 may facilitate a mounting of light fixture 116 such that illumination pattern 114 may be adjusted by a few degrees upward (e.g., 5 degrees upward) and a few degrees downward (e.g., 5 degrees downward) by allowing light fixture 116 to be rotated upward and downward, respectively, while light fixture 116 is mounted within the compartment of lighting bracket 110.

Figure 2:
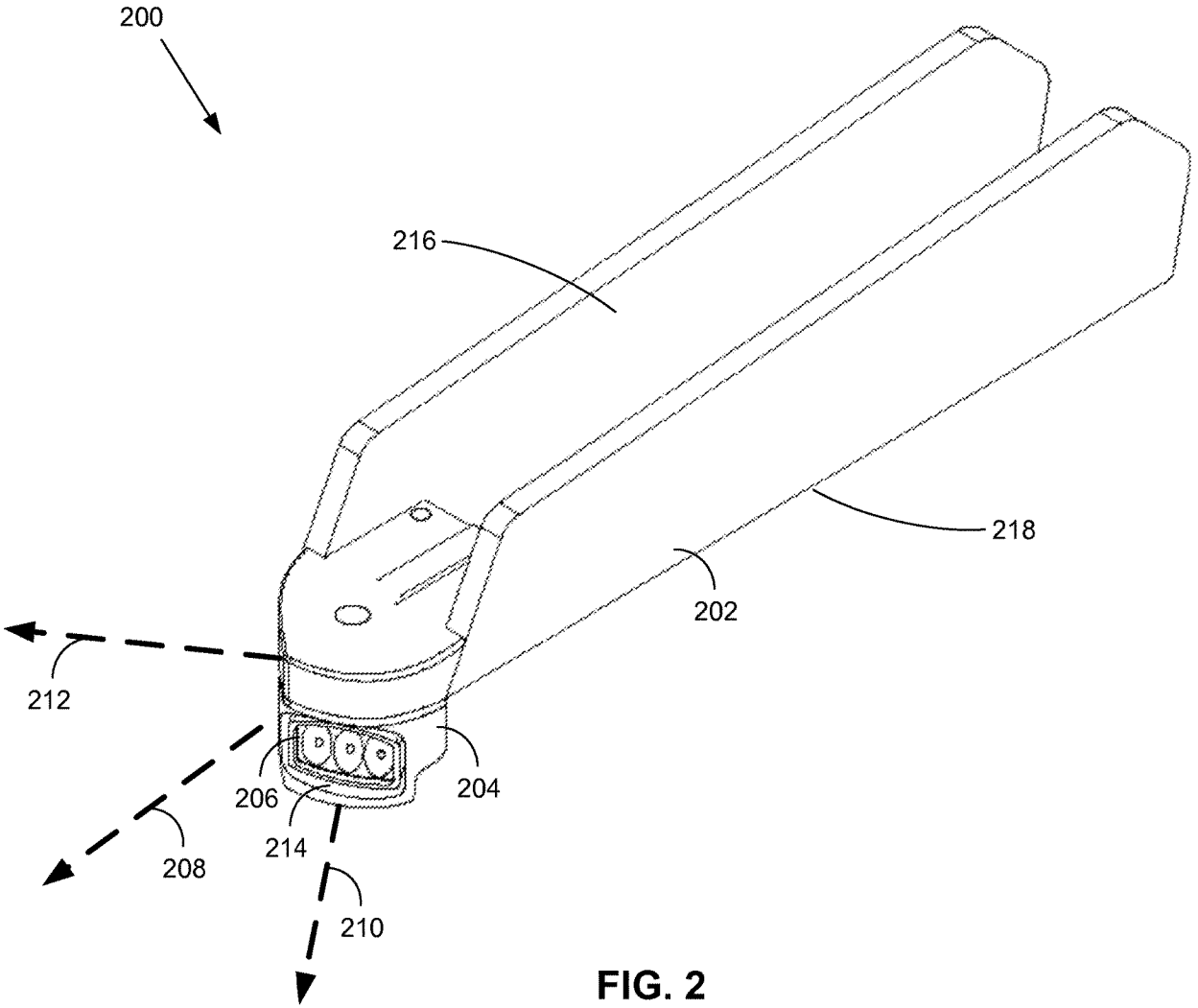
FIG. 2 illustrates a light fixture mounted within a trolling motor mounting bracket in accordance with one embodiment of the present invention.

Turning to FIG. 2, assembly 200 is illustrated, which may include bracket 202 (e.g., a mounting bracket for a trolling motor), light bracket 204 and a light fixture (e.g., LED light fixture 206). Light bracket 204 may, for example, be configured to accept light fixture 206 within cavity 214 of light bracket 204, such that light fixture 206 may be recessed within light bracket 204. Accordingly, for example, light fixture 206 may be protected from objects that would otherwise impact and damage light fixture 206, but for the existence of light bracket 204.

Light bracket 204 may, for example, facilitate the mounting of light fixture 206 as shown, such that an angle may exist between axis 208 (e.g., the longitudinal axis of bracket 202) and axis 210 (e.g., the axis along which light illuminated by light fixture 206 is projected). Accordingly, for example, bracket 202 may be mounted to a vehicle (e.g., a fishing boat) such that the longitudinal axis along bracket 202 (e.g., axis 208) is not necessarily aligned along a centerline of the vehicle, but due to the angle of light fixture 206 that may be produced by light bracket 204, light fixture 206 may nevertheless be substantially aligned with the centerline of the vehicle (e.g., along axis 210). Accordingly, for example, the light illuminated by light fixture 206 may be aligned with the centerline of the vehicle.

Alternately, light bracket 204 may, for example, facilitate the mounting of light fixture 206, such that an angle may exist between axis 208 (e.g., the longitudinal axis of bracket 202) and axis 212 (e.g., the axis along which light illuminated by light fixture 206 is projected). Accordingly, for example, bracket 202 may be mounted to a vehicle (e.g., a fishing boat) such that the longitudinal axis along bracket 202 (e.g., axis 208) is not necessarily aligned along a centerline of the vehicle, but due to the angle of light fixture 206 that may be produced by light bracket 204, light fixture 206 may nevertheless be substantially aligned with the centerline of the vehicle (e.g., along axis 212). Accordingly, for example, the light illuminated by light fixture 206 may be aligned with the centerline of the vehicle.

A bottom side (e.g., side 218) of bracket 202 may, for example, be configured to mount to a vehicle (e.g., a fishing boat) and a top side (e.g., side 216) of bracket 202 may, for example, be configured to accept an article of the vehicle (e.g., a trolling motor). Accordingly, LED light fixture 206 may be mounted to the vehicle (e.g., via bracket 204) without necessarily requiring any other surface area on the vehicle with which to be mounted.

Figure 3:
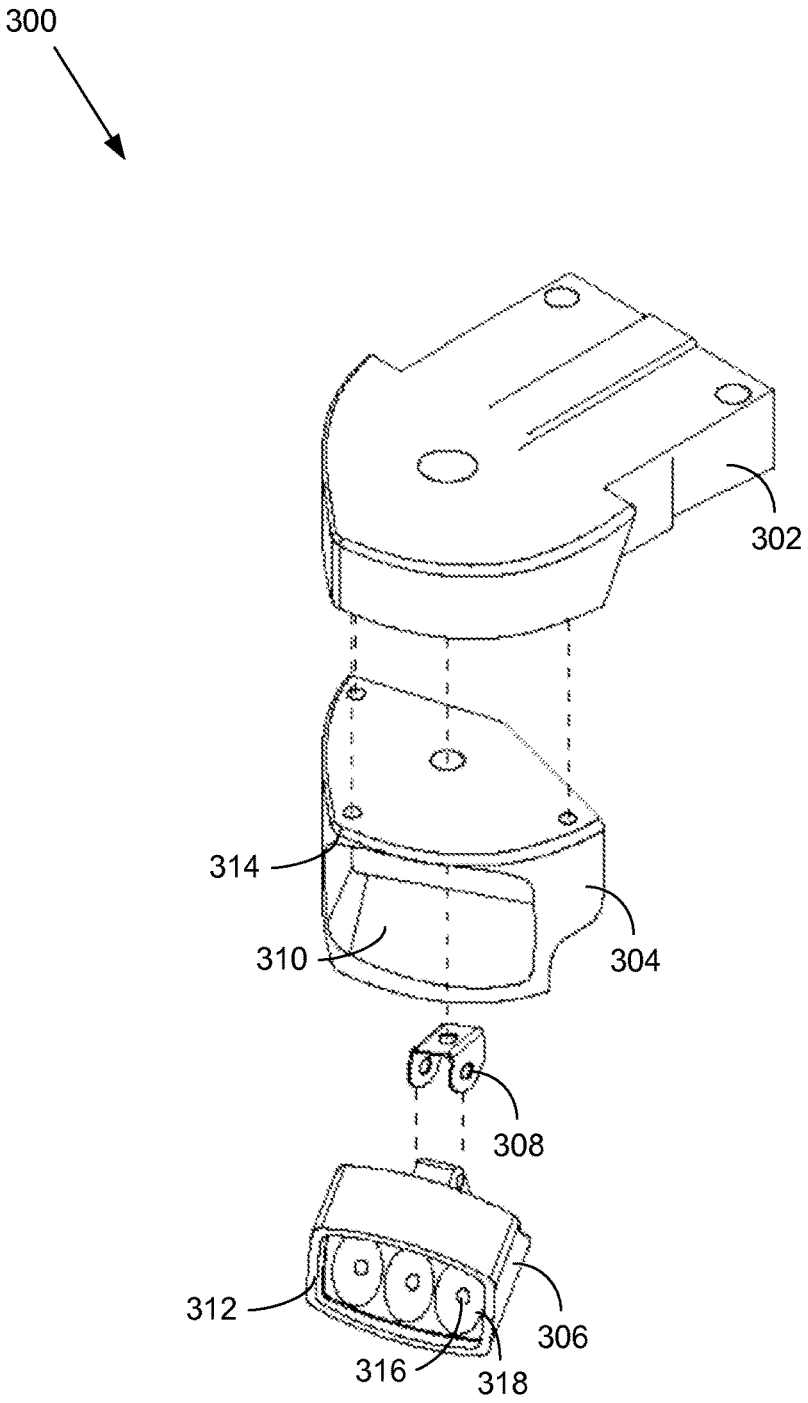
FIG. 3 illustrates a lighting fixture in accordance with one embodiment of the present invention.

Turning to FIG. 3, assembly 300 is illustrated, which may include top bracket 302, light bracket 304, a light fixture (e.g., LED light fixture 306) and bracket 308. As illustrated, light fixture 306 may fit within cavity 310 of light bracket 304, such that cavity 310 may fully encapsulate at least forward portion 312 of light fixture 306 when light fixture 306 is installed within cavity 310 of light bracket 304. Accordingly, for example, objects that may come into contact with forward portion 314 of light bracket 304 may be prohibited from also coming into contact with front portion 312 of light fixture 306. In so doing, light bracket 304 may provide protection for light fixture 306, such that when light fixture 306 is in use (e.g., utilized within a trolling motor mounting bracket), light fixture 306 may not be allowed to come into contact with foreign objects (e.g., the extension arm of a trolling motor).

Light fixture 306 may, for example, include one or more LEDs 316 and one or more associated reflectors 318. LEDs 316 may, for example, be mounted to a printed circuit board (PCB) (not shown) within light fixture 306. In addition, control circuitry (not shown) may also exist on the PCB to, for example, provide operational power and associated biasing to LEDs 316, such that LEDs 316 may become illuminated when desired. Reflectors 318 may, for example, be installed over LEDs 316, such that reflectors may, or may not, be in contact with the PCB. Reflectors 318 may, for example, exhibit a parabolic shape with a small opening on one end of the reflector and a larger opening on the opposite end of the reflector. The small opening of reflector 318 may, for example, be positioned proximate to its associated LED 316.

As LEDs 316 illuminate, a portion of illuminated light may be directed forward of the LED through both the small and large openings of its associated reflector and may not be reflected by the reflector. Other portions of the light projected by LEDs 316 may be directed through the small opening of its associated reflector and reflected by an inner portion of the reflector to an area forward of the LED. Accordingly, for example, a substantial portion of the light emitted by each of LEDs 316 may either be projected forward of the LED and/or may be reflected by the associated reflectors forward of the LED.

Bracket 308 may, for example, allow light fixture 306 to be rotated in an upward direction within cavity 310. Similarly, bracket 308 may, for example, allow light fixture 306 to be rotated in a downward direction within cavity 310. Accordingly, for example, light emitted by light fixture 306 may be caused to illuminate a few degrees upward (e.g., 5 degrees upward) or a few degrees downward (e.g., 5 degrees downward) while light fixture 306 remains mounted within light bracket 304.

Figure 4:
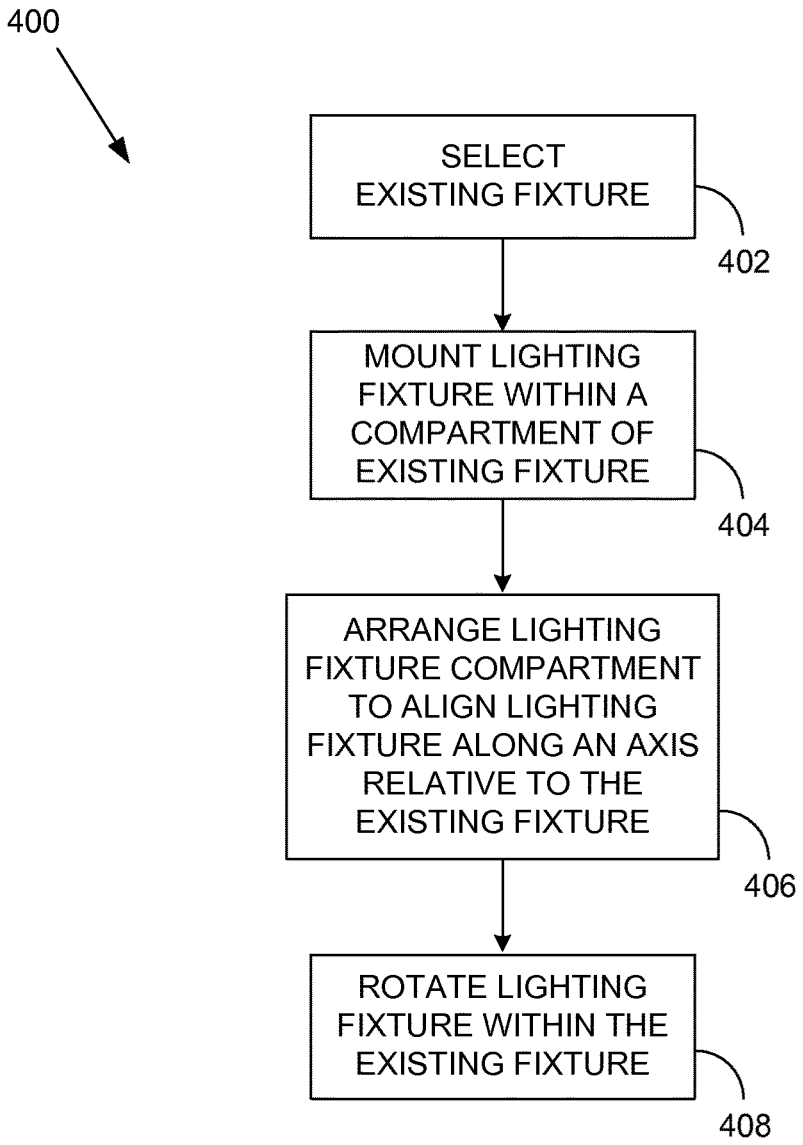
FIG. 4 illustrates a flow diagram in accordance with one embodiment of the present invention.

Turning to FIG. 4, a flow diagram is illustrated, which may include selecting an existing fixture (e.g., selecting a trolling motor mount as in step 402) that may preexist on a vehicle (e.g., a watercraft). In step 404, a compartment within the existing fixture may be selected within which to mount a lighting fixture (e.g., an LED-based lighting fixture). Step 404 may, for example, include altering at least a portion of the existing fixture to accommodate a compartment that may fit within the existing fixture. In one embodiment, the compartment may be configured to accept a lighting fixture and may be configured as a rigid, flexible or semi-rigid/semi-flexible compartment.

In step 406, the lighting fixture compartment of step 404 may be configured to arrange the lighting fixture parallel to an axis that is relative to the existing fixture (e.g., parallel to the centerline axis of the vehicle to which the existing fixture is mounted). In one embodiment, the compartment may accept the lighting fixture at an angle, such that irrespective of the mounting angle of the existing fixture, the angle of the lighting fixture may nevertheless be arranged to be along any axis of interest (e.g., the longitudinal axis of the watercraft) so that once illuminated, the lighting fixture may project light forward along the path traveled by the watercraft away from the inside of the watercraft. In so doing, for example, light may be projected away from the watercraft in a direction that may illuminate the path that is to be travelled by the watercraft, much like a headlight for a motor vehicle.

The lighting fixture may, for example, be mounted within the existing fixture, such that the lighting fixture may be rotated within the existing fixture after being mounted within the existing fixture (e.g., as in step 408). In one embodiment, for example, the lighting fixture may be rotated upward (e.g., between 0 and 10 degrees above the horizon), to allow light to be emanated from the light fixture at a variable angle above the horizon. In an alternate embodiment, for example, the lighting fixture may be rotated downward (e.g., between 0 and 10 degrees below the horizon), to allow light to be emanated from the light fixture at a variable angle below the horizon.

Other aspects and embodiments of the present invention will be apparent to those skilled in the art from consideration of the specification and practice of the invention disclosed herein. It is intended, therefore, that the specification and illustrated embodiments be considered as examples only, with a true scope and spirit of the invention being indicated by the following claims.

What is claimed is:

1. A lighting system, comprising:

a mounting bracket having a first side coupled to a vehicle and a second side operable to receive a trolling motor; and a light bracket disposed within the mounting bracket, the light bracket including a light fixture mounted within a cavity of the light bracket, the light fixture operable to illuminate portions outside of the vehicle whether or not the trolling motor is operational.

2. The lighting system of claim 1, wherein the mounting bracket has a longitudinal axis which is fixed with respect to the vehicle.

3. The lighting system of 2, wherein the longitudinal axis of the mounting bracket is nonparallel to a longitudinal centerline of the vehicle.

4. The lighting system of claim 1, wherein the light fixture emits light along a light illumination axis which is fixed with respect to the vehicle and irrespective of a position of the trolling motor.

5. The lighting system of claim 4, wherein the light illumination axis is substantially parallel to a longitudinal centerline of the vehicle.

6. The lighting system of claim 4, wherein the light illumination axis is substantially aligned with a longitudinal centerline of the vehicle.

7. The lighting system of claim 4, wherein the light illumination axis is at an angle with respect to a longitudinal axis of the mounting bracket.

8. A lighting system, comprising:

a mounting bracket having a first side coupled to a vehicle and a second side operable to receive a non lighting device; and a light bracket disposed within the mounting bracket, the light bracket including a light fixture mounted within a cavity of the light bracket, the light fixture operable to illuminate portions outside of the vehicle;

wherein the light fixture emits light in a constant direction with respect to the vehicle whether or not the non lighting device is operational.

9. The lighting system of claim 8, wherein the second side of the mounting bracket is coupled to the non lighting device and the non lighting device is deployed.

10. The lighting system of claim 9, wherein operation of the light fixture in the constant direction is unimpeded by operation of the non lighting device.

11. The lighting system of claim 8, wherein the second side of the mounting bracket is coupled to the non lighting device and the non lighting device is stowed.

12. The lighting system of claim 8, wherein the light fixture is rotatable to enable the direction of the emitted light to be rotated both upward and downward.

13. The lighting system of claim 8, wherein the light bracket extends forwardly of a forward portion of the light fixture.

14. The lighting system of claim 8, wherein the light fixture includes one or more LEDs.

15. A method, comprising:

selecting an existing fixture mounted to a vehicle, the existing fixture being mounted along a first axis;

altering a mounting bracket of the existing fixture to accommodate a compartment;

mounting a light fixture along a second axis within the compartment; and emitting light from the light fixture in a constant direction with respect to the vehicle whether or not the existing fixture is operational.

16. The method of claim 15, wherein the first axis and the second axis are different.

17. The method of claim 15, wherein light emitted by the light fixture is unimpeded by the non lighting device.

18. The method of claim 15, further comprising:

operating the non lighting device to move the vehicle in a direction of travel;

wherein light is emitted in the direction of travel.

19. The method of claim 15, further comprising:

rotating the light fixture upward to allow light to be emitted at an angle above the horizon.

20. The method of claim 15, further comprising:

rotating the light fixture downward to allow light to be emitted at an angle below the horizon.

* * * * *